US009739168B2

(12) United States Patent
Ekanayake et al.

(10) Patent No.: US 9,739,168 B2
(45) Date of Patent: Aug. 22, 2017

(54) OFF-LINE WASH SYSTEMS AND METHODS FOR A GAS TURBINE ENGINE

(71) Applicant: General Electric Company, Schenectady, NY (US)

(72) Inventors: Sanji Ekanayake, Atlanta, GA (US); Alston Ilford Scipio, Atlanta, GA (US)

(73) Assignee: General Electric Company, Schenectady, NY (US)

( * ) Notice: Subject to any disclaimer, the term of this patent is extended or adjusted under 35 U.S.C. 154(b) by 507 days.

(21) Appl. No.: 14/297,060

(22) Filed: Jun. 5, 2014

(65) Prior Publication Data

US 2015/0354404 A1 Dec. 10, 2015

(51) Int. Cl.

| | |
|---|---|
| ***F01D 25/00*** | (2006.01) |
| ***B08B 3/02*** | (2006.01) |
| ***C11D 11/00*** | (2006.01) |
| ***C11D 3/16*** | (2006.01) |

(52) U.S. Cl.

CPC ..... *F01D 25/002* (2013.01); *B08B 3/02* (2013.01); *C11D 3/162* (2013.01); *C11D 11/0041* (2013.01); *F05D 2260/607* (2013.01)

(58) Field of Classification Search

None

See application file for complete search history.

(56) References Cited

U.S. PATENT DOCUMENTS

| | | | | |
|---|---|---|---|---|
| 6,659,715 | B2 | 12/2003 | Kuesters et al. | |
| 2002/0141882 | A1 | 10/2002 | Ingistov et al. | |
| 2009/0158739 | A1 | 6/2009 | Messmer | |
| 2010/0037924 | A1 * | 2/2010 | Gebhardt | F01D 25/002 134/115 R |
| 2013/0330172 | A1 | 12/2013 | Scipio et al. | |

* cited by examiner

*Primary Examiner* — Michael Barr
*Assistant Examiner* — Jason Riggleman
(74) *Attorney, Agent, or Firm* — Eversheds Sutherland (US) LLP

(57) ABSTRACT

The present application and the resultant patent provide a wash system for a gas turbine engine. The wash system may include a water source containing a volume of water therein, and a surface filming agent source containing a volume of a surface filming agent therein. The wash system also may include a mixing chamber in fluid communication with the water source and the surface filming agent source, wherein the mixing chamber is configured to mix the water and the surface filming agent therein to produce a film-forming mixture. The wash system further may include an aerosolizing device in fluid communication with the mixing chamber and configured to form an aerosol spray of the film-forming mixture and a propellant. The wash system still further may include a number of supply lines in fluid communication with the aerosolizing device and configured to direct the aerosol spray into the gas turbine engine.

20 Claims, 5 Drawing Sheets

OFF-LINE WASH SYSTEMS AND METHODS FOR A GAS TURBINE ENGINE

TECHNICAL FIELD

The present application and the resultant patent relate generally to gas turbine engines and more particularly relate to off-line wash systems and related methods for effective washing and application of a surface filming agent to internal components of a gas turbine engine.

BACKGROUND OF THE INVENTION

As a gas turbine engine operates, airborne contaminants may accumulate on various internal components of the engine, such as the blades and the vanes of the compressor. Although the gas turbine engine system may include an inlet air filtration system, a certain degree of contaminant accumulation may be unavoidable and may depend on various environmental conditions at the site of operation. Common contaminants may include small amounts of dust and debris that pass through the inlet air filtration system as well as un-filterable hydrocarbon-based materials such as smoke, soot, grease, oil film, and organic vapors. Over time, accumulation of contaminants on the compressor blades and vanes may restrict airflow through the compressor and may shift the airfoil pattern. In this manner, such accumulation may adversely impact the performance and efficiency of the compressor and thus the overall performance and efficiency of the gas turbine engine, particularly resulting in decreased power output, increased fuel consumption, and increased operating costs.

In order to reduce contaminant accumulation, the gas turbine engine system may include a water wash system for removing contaminant particles from the compressor blades and vanes. For example, an on-line water wash system may be used to remove contaminant particles from compressor blades and vanes via a flow of water, such as demineralized water, while the gas turbine engine is operating at full speed and is loaded. The on-line water wash system may deliver the flow of water upstream of the compressor via an on-line manifold including nozzles positioned about a bellmouth of the compressor. The nozzles may create a spray mist of water droplets in this region of relatively low velocity air, and the negative pressure produced by the operating compressor may draw the spray mist into contact with the compressor blades and vanes for contaminant removal.

An off-line water wash system may be used in a similar manner to more effectively remove contaminant particles via a flow of water and detergent while the gas turbine engine is shut down or operating at a turning gear speed and is not loaded. The off-line water wash system may deliver the flow of water and detergent upstream of the compressor via an off-line manifold including nozzles positioned about a bellmouth of the compressor. In certain applications, a water wash system may be configured to operate in either an on-line mode or an off-line mode. In this manner, on-line washes may be carried out periodically to increase performance and efficiency of the gas turbine engine when the operating schedule does not permit shutdown time so as to perform a more effective off-line wash. The frequency and duration of on-line and off-line washes may vary depending on the degree of contaminant accumulation and environmental conditions at the site of operation.

Although conventional water wash systems and methods may be effective in removing contaminants from the blades and vanes of early compressor stages, such systems and methods often are less effective in removing contaminants from the blades and vanes of later compressor stages because the flow of water and detergent generally is injected about the bellmouth of the compressor. Moreover, following a wash with such systems and methods, residual amounts of the water and detergent may remain on the compressor blades and vanes, which may have an adverse impact on subsequent restart and operation of the gas turbine engine. The residual amounts of water and detergent also may facilitate surface rusting, corrosion, or subsequent accumulation of contaminants on the compressor blades and vanes. Further, the performance gain provided by conventional water wash systems and methods may of limited duration, necessitating frequent washes carried out with the water wash systems or by hand in order to maintain adequate performance, which ultimately may increase total operating costs of the gas turbine engine.

There is thus a desire for improved wash systems and methods for removing contaminants from internal components of a gas turbine engine, such as compressor blades and vanes. Specifically, such improved wash systems and methods should effectively remove contaminants from the blades and vanes of all compressor stages, particularly later compressor stages, while also inhibiting surface rusting, corrosion, and subsequent accumulation of contaminants on the compressor blades and vanes. Further, as compared to conventional wash systems and methods, such improved wash systems and methods should increase the duration of performance gains provided thereby and thus decrease the frequency of washes required to maintain adequate performance of the gas turbine engine. Ultimately, such improved wash systems and methods should increase efficiency and performance of the gas turbine engine and decrease total operating costs.

SUMMARY OF THE INVENTION

The present application and the resultant patent provide a wash system for a gas turbine engine. The wash system may include a water source containing a volume of water therein, and a surface filming agent source containing a volume of a surface filming agent therein. The wash system also may include a mixing chamber in fluid communication with the water source and the surface filming agent source, wherein the mixing chamber is configured to mix the water and the surface filming agent therein to produce a film-forming mixture. The wash system further may include an aerosolizing device in fluid communication with the mixing chamber, wherein the aerosolizing device is configured to form an aerosol spray of the film-forming mixture and a propellant. The wash system still further may include a number of supply lines in fluid communication with the aerosolizing device, wherein the supply lines are configured to direct the aerosol spray into the gas turbine engine.

The present application and the resultant patent also provide a method of washing a gas turbine engine to remove contaminants therefrom. The method may include the steps of directing a cleaning mixture through an air extraction system of the gas turbine engine, applying the cleaning mixture to internal components of the gas turbine engine, and rinsing the cleaning mixture from the internal components. The cleaning mixture may include water and a cleaning agent. The method also may include the steps of directing an aerosol spray of a film-forming mixture and a propellant through the air extraction system, applying the aerosol spray to the internal components, and drying the film-forming mixture to form a protective film on the internal components. The film-forming mixture may include water and a surface filming agent.

The present application and the resultant patent further provide a gas turbine engine system. The gas turbine engine system may include a gas turbine engine and a wash system. The gas turbine engine may include a compressor, a combustor in communication with the compressor, a turbine in communication with the combustor, and an air extraction system in communication with the compressor and the turbine. The wash system may include a water source containing a volume of water therein, and a surface filming agent source containing a volume of a surface filming agent therein. The wash system also may include a mixing chamber in fluid communication with the water source and the surface filming agent source, wherein the mixing chamber is configured to mix the water and the surface filming agent therein to produce a film-forming mixture. The wash system further may include an aerosolizing device in fluid communication with the mixing chamber, wherein the aerosolizing device is configured to form an aerosol spray of the film-forming mixture and a propellant. The wash system still further may include a number of supply lines in fluid communication with the aerosolizing device and the air extraction system, wherein the supply lines are configured to direct the aerosol spray into the compressor and the turbine via the air extraction system.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
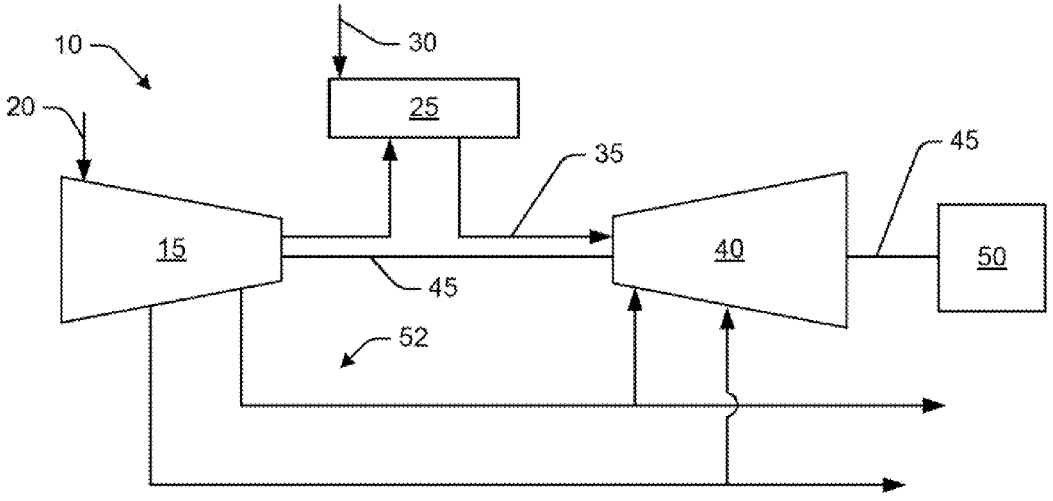
FIG. 1 is a schematic diagram of a gas turbine engine including a compressor, a combustor, a turbine, a load, and an air extraction system.

Referring now to the drawings, in which like numerals refer to like elements throughout the several views, FIG. 1 shows a schematic diagram of a gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like. The gas turbine engine 10 also may include an air extraction system 52 extending between the compressor 15 and the turbine 40. The air extraction system 52 extracts a portion of the compressed flow of air 20 from one or more stages of the compressor 15 and directs the portion of the compressed flow of air 20 to one or more stages of the turbine 40 for use in cooling the turbine 40. Other configurations and other components may be used herein.

The gas turbine engine 10 may use natural gas, liquid fuels, various types of syngas, and/or other types of fuels and combinations thereof. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
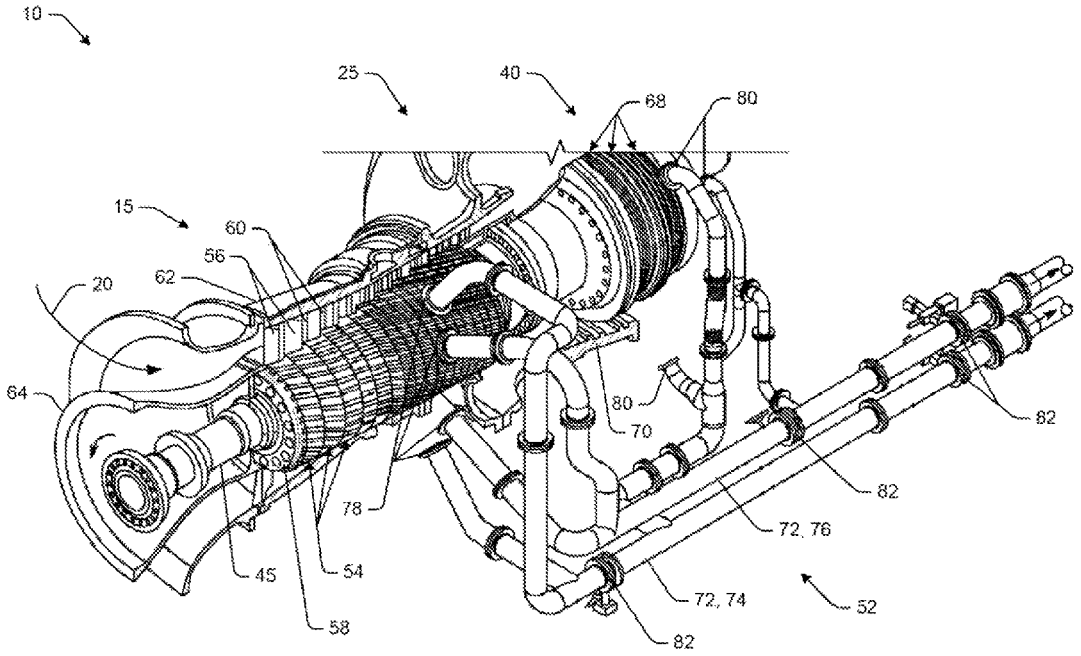
FIG. 2 is perspective view, in partial section, of a portion of the gas turbine engine of FIG. 1, showing portions of the compressor, the combustor, the turbine, and the air extraction system.

FIG. 2 shows a perspective view, in partial section, of a portion of the gas turbine engine 10, including portions of the compressor 15, the combustor 25, the turbine 40, and the air extraction system 52. As is shown, the compressor 15 may include a number of stages 54. Although eighteen stages 54 are shown, the compressor 15 may include any number of stages 54. Each stage 54 may include a number of rotating compressor blades 56 arranged in a circumferential array about an axis of the compressor 15. Each stage 54 may include any number of compressor blades 56. The compressor blades 56 may be mounted onto a rotor wheel 58 of the compressor 15. The rotor wheel 58 may be attached to the shaft 45 for rotation therewith. Each stage 54 also may include a number of stationary compressor vanes 60 arranged in a circumferential array about an axis of the compressor 15. Each stage 54 may include any number of compressor vanes 60. The compressor vanes 60 may be mounted onto a compressor outer casing 62. The outer casing 62 may extend over the number of stages 54 from a bellmouth 64 of the compressor 15 toward the turbine 40. During operation of the gas turbine engine 10, the flow of air 20 enters the compressor 15 about the bellmouth 64 and is compressed through the compressor blades 56 and the compressor vanes 60 of the number of stages 54 before flowing to the combustor 25. As is shown, the turbine 40 may include a number of stages 68. Although three stages 68 are shown, the turbine 40 may include any number of stages 68. Each stage 68 may include a number of rotating turbine blades (not shown) and a number of stationary turbine vanes (not shown) respectively arranged in circumferential arrays about an axis of the turbine 40. The turbine 40 also may include a turbine outer casing 70 extending over the number of stages 68.

The air extraction system 52 may include a number of air extraction lines 72 each extending between the compressor 15 and the turbine 40. For example, the air extraction system 52 may include a first air extraction line 74 extending between one of the stages 54 of the compressor 15 and one of the stages 68 of the turbine 40, and a second air extraction line 76 extending between another one of the stages 54 of the compressor 15 and another one of the stages 68 of the turbine 40. In certain embodiments, the first air extraction line 74 may extend between a ninth stage of the compressor 15 and a third stage of the turbine 40, and the second air extraction line 76 may extend between a thirteenth stage of the compressor 15 and a second stage of the turbine 40, as is shown. Although two air extraction lines 72 are shown, the air extraction system 52 may include any number of air extraction lines 72. Further, according to various embodiments, each of the air extraction lines 72 may extend between any stage 54 of the compressor 15 and any stage 68 of the turbine 40. Each of the air extraction lines 72 may include one or more inlet ports 78 positioned about the respective stage 54 of the compressor 15 and configured for extracting a portion of the compressed flow of air 20 therefrom, and one or more outlet ports 80 positioned about the respective stage 68 of the turbine 40 and configured for delivering the portion of the compressed flow of air 20 thereto. The inlet ports 78 may be attached to the compressor outer casing 62, and the outlet ports 80 may be attached to the turbine outer casing 70. Each of the air extraction lines 72 also may include one or more valves 82 configured to control the compressed flow of air 20 passing therethrough. During operation of the gas turbine engine 10, the air extraction lines 72 extract portions of the compressed flow of air 20 from the respective stages 54 of the compressor 15 and deliver the portions of the compressed flow of air 20 to the respective stages 68 of the turbine 40 for use in cooling the turbine 40.

Figure 3:
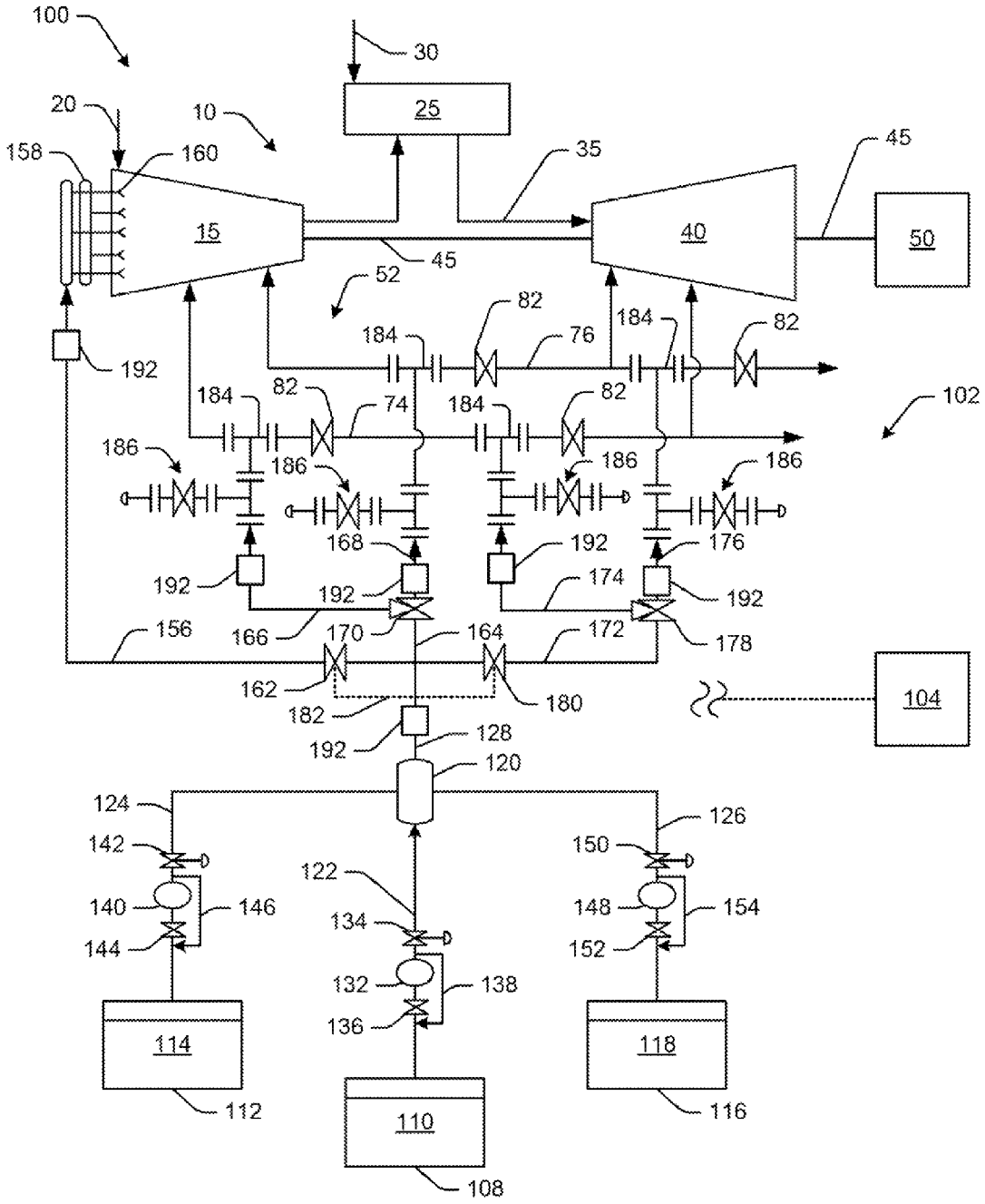
FIG. 3 is a schematic diagram of a gas turbine engine system as may be described herein, the system including a gas turbine engine, a wash system, and a system controller.

FIG. 3 shows a schematic diagram of a gas turbine engine system 100 as may be described herein. The gas turbine engine system 100 may include the gas turbine engine 10 described above, as is shown. The gas turbine engine system 100 also may include a wash system 102 in communication with the gas turbine engine 10. The wash system 102 may be configured to remove contaminants from and to apply a surface filming agent to internal components of the gas turbine engine 10, such as the compressor blades 56 and the compressor vanes 60, as may be described in detail herein below. The gas turbine engine system 100 further may include a system controller 104 in communication with the gas turbine engine 10 and the wash system 102 and operable to monitor and control various operating parameters of the gas turbine engine system 100. The system controller 104 also may be operable to carry out and control a wash process via the wash system 102, as may be described in detail herein below with respect to FIG. 6. In certain embodiments, the system controller 104 may be in communication with various components of the gas turbine engine 10 and the wash system 102 as necessary to monitor and control the desired operating parameters and to carry out and control the wash process (for illustration purposes, specific connections are not shown in FIG. 3).

As is shown in FIG. 3, the wash system 102 may include a water source 108 containing a volume of water 110 therein. The water source 108 may have any size, shape, or configuration. In certain embodiments, the water 110 may be demineralized water. The wash system 102 also may include a cleaning agent source 112 containing a volume of a cleaning agent 114 therein. The cleaning agent source 112 may have any size, shape, or configuration. The cleaning agent 114 may be any type of cleaning agent suitable for removing contaminants from surfaces of internal components of the gas turbine engine 10, such as the compressor blades 56 and the compressor vanes 60. The wash system 102 further may include a surface filming agent source 116 containing a volume of a surface filming agent 118 therein. The surface filming agent source 116 may have any size, shape, or configuration. The surface filming agent 118 may be any type of filming agent suitable for forming a protective film on surfaces of internal components of the gas turbine engine 10, such as the compressor blades 56 and the compressor vanes 60.

The cleaning agent 114 generally may include one or more surfactants and one or more corrosion inhibiting dispersants. As used herein, "corrosion inhibiting dispersants" refer to dispersants that help remove scales, foulants, and/or other deposits that may potentially corrode internal components of the gas turbine engine 10. During operation of the wash system 102, the cleaning agent 114 may be mixed with the water 110 to form a cleaning mixture of the cleaning agent 114 and the water 110, as may be described herein below. In certain embodiments, the one or more surfactants and the one or more corrosion inhibiting dispersants (i.e., the actives) may combine to constitute from about 1 weight percent to about 20 weight percent, as actives, of the cleaning mixture. In certain embodiments, the one or more surfactants and the one or more corrosion inhibiting dispersants (i.e., the actives) may combine to constitute from about 5 weight percent to about 10 weight percent of the cleaning mixture. Other weight percentages may be used herein.

In certain embodiments, the one or more surfactants may be selected from sodium lauryl sulphate, sodium dodecyl benzene sulphonate, and ethylene oxide and propylene oxide block copolymers. For example, the one or more surfactants may include up to about 30 weight percent ethylene oxide and propylene oxide block copolymers, with the balance including sodium lauryl sulphate and sodium dodecyl benzene sulphonate. Further, in certain embodiments, the one or more corrosion inhibiting dispersants may be selected from acrylic acid-co-allyloxy propyl hydroxyl sulphates, hydroxyl propyl sulphonic acid, copolymers of acrylic acid and 2-acrylamido-2-methyl-1-propane sulfonic acid, poly maleic acid, polyepoxysuccinic acid, and terpolymer of acrylic acid. In certain embodiments, the one or more corrosion inhibiting dispersants may combine to constitute from about 10 weight percent to about 50 weight percent of the total actives of the cleaning agent 114. Other weight percentages may be used herein.

The surface filming agent 118 generally may include one or more fluoro silanes and one or more additional silanes. During operation of the wash system 102, the surface filming agent 118 may be mixed with the water 110 to form a film-forming mixture of the surface filming agent 118 and the water 110, as may be described herein below. In certain embodiments, the one or more additional silanes may be selected from mercapto silane, amino silane, tetraethyl orthosilicate, and succinic anhydride silane. In certain embodiments, the ratio of the one or more fluoro silanes to the one or more additional silanes may be from about 90:10 to about 50:50. In certain embodiments, the ratio of the one or more fluoro silanes to the one or more additional silanes may be about 50:50. In certain embodiments, the one or more fluoro silanes and the one or more additional silanes may combine to constitute from about 0.5 weight percent to about 10 weight percent of the film-forming mixture. Other weight percentages may be used herein. In certain embodiments, the pH of the water 110 may be adjusted to from about 4.5 to about 5.5 using acetic acid while adding the silane to achieve a concentration of from about 0.5% to about 2%.

The surface filming agent 118 may be configured to form a protective film on surfaces of internal components of the gas turbine engine 10, such as the compressor blades 56 and the compressor vanes 60, when applied thereto. In this manner, the resulting film may limit future corrosion from foulants and other deposits. For example, the one or more fluoro silanes of the surface filming agent 118 may function as an anti-foulant and/or inhibit corrosion, while the one or more additional silanes may function as a corrosion inhibitor while also imparting binding between the film and the internal components of the gas turbine engine 10. In certain embodiments, the resulting film may withstand temperatures of at least 350° C. (662° F.). As used herein, "withstand" refers to not showing significant signs of degradation after prolonged exposure to the elevated temperature. Moreover, the resulting film may be hydrophobic and oleophobic to help prevent the resident buildup of fluids (e.g., water and oil) and/or other foulants. As used herein, "hydrophobic" refers to the physical property of a material that is water repellent, and "oleophobic" refers to the physical property of a material that is oil repellent. Specifically, surfaces with low surface energy for a foulant (e.g., water and/or oil) should have a high contact angle and should provide reduced adhesion with the foulant relative to a surface which is wet by the foulant or with which the foulant has a low contact angle. As used herein, "contact angle" refers to the angle formed by a static liquid droplet on the surface of a solid material. The higher the contact angle, the less the interaction of the liquid with the surface. Thus, it is more difficult for the foulant to wet or adhere to the surface if the contact angle of the foulant with the surface is high. In certain embodiments, the resulting film may have a contact angle of at least 135 degrees. Other contact angles may be used herein.

Although specific embodiments of the cleaning agent 114 and the surface filming agent 118 are described herein above, it will be understood that such embodiments are non-limiting examples and that other compositions incorporating additional and/or alternative materials also may be realized. Further, it will be understood that the cleaning mixture and the film-forming mixture may include additional and/or alternative materials.

As is shown in FIG. 3, the wash system 102 also may include a mixing chamber 120, a water supply line 122, a cleaning agent supply line 124, a surface filming agent supply line 126, and a mixture supply line 128. The water source 108 may be in fluid communication with the mixing chamber 120 via the water supply line 122. The cleaning agent source 112 may be in fluid communication with the mixing chamber 120 via the cleaning agent supply line 124. The surface filming agent source 116 may be in fluid communication with the mixing chamber 120 via the surface filming agent supply line 126. The mixing chamber 120 may be configured to receive and mix the water 110 and the cleaning agent 114 to form the cleaning mixture during a portion of the wash process, and to receive and mix the water 110 and the surface filming agent 118 to form the film-forming mixture during another portion of the wash process. The mixture supply line 128 may extend from the mixing chamber 120 toward the gas turbine engine 10. In this manner, the mixture supply line 128 may be configured to deliver the cleaning mixture during a portion of the wash process, and to deliver the film-forming mixture during another portion of the wash process.

Figure 4:
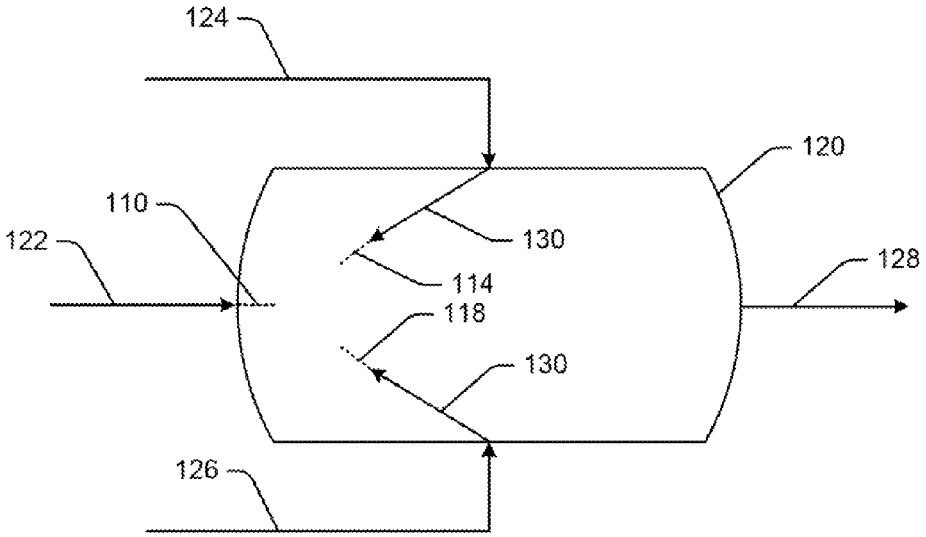
FIG. 4 is a detailed schematic diagram of a mixing chamber and related supply lines as may be used in the gas turbine engine system of FIG. 3.

FIG. 4 shows a detailed schematic diagram of the mixing chamber 120 and the supply lines 122, 124, 126, 128. The mixing chamber 120 may include a number of angled counter flow nozzles 130 configured to deliver a flow of the cleaning agent 114, the surface filming agent 118, or other type of secondary fluid for mixing therein. As is shown, the angled counter flow nozzles 130 may be configured to deliver the respective flows of the cleaning agent 114, the surface filming agent 118, or other type of secondary fluid at an acute angle into the incoming flow of the water 110 or other type of primary flow to provide enhanced mixing within the mixing chamber 120 without the use of moving parts. The angled counter flow nozzles 130 also may be configured to deliver the respective flows of the cleaning agent 114, the surface filming agent 118, or other type of secondary fluid at a higher pressure than the incoming flow of the water 110 or other type of primary flow to provide enhanced mixing within the mixing chamber 120 without the use of moving parts. The mixing chamber 120 may have any size, shape, or configuration.

The respective supply lines 122, 124, 126 may have a number of pumps, valves, and return lines positioned thereon and configured to control the respective flows therethrough. As is shown, the water supply line 122 may have a water pump 132, a pair of water line isolation valves 134, 136, and a water return line 138 positioned thereon and configured to control the flow of the water 110 to the mixing chamber 120. In a similar manner, the cleaning agent supply line 124 may have a cleaning agent pump 140, a pair of cleaning agent line isolation valves 142, 144, and a cleaning agent return line 146 positioned thereon and configured to control the flow of the cleaning agent 114 to the mixing chamber 120. Further, the surface filming agent supply line 126 may have a surface filming agent pump 148, a pair of surface filming agent line isolation valves 150, 152, and a surface filming agent return line 154 positioned thereon and configured to control the flow of the surface filming agent 118 to the mixing chamber 120. The pumps, valves, and return lines may be of conventional design. Other components may be positioned on the supply lines 122, 124, 126 and other configurations may be used herein.

As is shown in FIG. 3, the wash system 102 also may include a bellmouth supply line 156 extending from the mixture supply line 128 toward the gas turbine engine 10. The wash system 102 further may include a bellmouth manifold 158 positioned about the bellmouth 64 of the compressor 15. The bellmouth manifold 158 may include a number of bellmouth nozzles 160 extending about the bellmouth 64. The bellmouth manifold 158 may be in fluid communication with the mixture supply line 128 via the bellmouth supply line 156. In this manner, the bellmouth manifold 158 may be configured to deliver the cleaning mixture into the compressor 15 about the bellmouth 64 during a portion of the wash process, and to deliver the film-forming mixture into the compressor 15 about the bellmouth 64 during another portion of the wash process. The bellmouth supply line 156 may have a bellmouth supply valve 162 positioned thereon and configured to control a flow of the mixture therethrough.

The wash system 102 also may include a main compressor supply line 164, a first branch compressor supply line 166, and a second branch compressor supply line 168, as is shown. The main compressor supply line 164 may extend from the mixture supply line 128 to a compressor branch valve 170, which may be a three-way valve connecting the main compressor supply line 164, the first branch compressor supply line 166, and the second branch compressor supply line 168. As is shown, the first branch compressor supply line 166 may extend from the compressor branch valve 170 to the first air extraction line 74, and the second branch compressor supply line 168 may extend from the compressor branch valve 170 to the second air extraction line 76. Accordingly, the first air extraction line 74 may be in fluid communication with the mixture supply line 128 via the first branch compressor supply line 166 and the main compressor supply line 164. In this manner, the first air extraction line 74 may be configured to deliver the cleaning mixture into the respective stage 54 (such as the ninth stage) of the compressor 15 during a portion of the wash process, and to deliver the film-forming mixture of the water 110 and the surface filming agent 118 into the respective stage 54 (such as the ninth stage) of the compressor 15 during another portion of the wash process. Further, the second air extraction line 76 may be in fluid communication with the mixture supply line 128 via the second branch compressor supply line 168 and the main compressor supply line 164. In this manner, the second air extraction line 76 may be configured to deliver the cleaning mixture into the respective stage 54 (such as the thirteenth stage) of the compressor 15 during a portion of the wash process, and to deliver the film-forming mixture of the water 110 and the surface filming agent 118 into the respective stage 54 (such as the thirteenth stage) of the compressor 15 during another portion of the wash process.

The wash system 102 also may include a main turbine supply line 172, a first branch turbine supply line 174, and a second branch compressor supply line 176, as is shown. The main turbine supply line 172 may extend from the mixture supply line 128 to a turbine branch valve 178, which may be a three-way valve connecting the main turbine supply line 172, the first branch turbine supply line 174, and the second branch turbine supply line 176. As is shown, the first branch turbine supply line 174 may extend from the turbine branch valve 178 to the first air extraction line 74, and the second branch turbine supply line 176 may extend from the turbine branch valve 178 to the second air extraction line 76. Accordingly, the first air extraction line 74 may be in fluid communication with the mixture supply line 128 via the first branch turbine supply line 174 and the main turbine supply line 172. In this manner, the first air extraction line 74 may be configured to deliver the cleaning mixture into the respective stage 68 (such as the third stage) of the turbine 40 during a portion of the wash process, and to deliver the film-forming mixture into the respective stage 68 (such as the third stage) of the turbine 40 during another portion of the wash process. Further, the second air extraction line 76 may be in fluid communication with the mixture supply line 128 via the second branch turbine supply line 176 and the main turbine supply line 172. In this manner, the second air extraction line 76 may be configured to deliver the cleaning mixture into the respective stage 68 (such as the second stage) of the turbine 40 during a portion of the wash process, and to deliver the film-forming mixture into the respective stage 68 (such as the second stage) of the turbine 40 during another portion of the wash process. The main turbine supply line 172 may have a turbine supply valve 180 positioned thereon and configured to control a flow of the mixture therethrough. As is shown, the bellmouth supply valve 162 and the turbine supply valve 180 may be in communication with one another via a valve interlock 182. In certain embodiments, the valve interlock 182 may be configured so that only one of the bellmouth supply valve 162 and the turbine supply valve 180 may be open at any given time, but that both the bellmouth supply valve 162 and the turbine supply valve 180 may be closed at the same time. In other embodiments, the bellmouth supply valve 162 and the turbine supply valve 180 may be separately and independently controlled.

Figure 5:
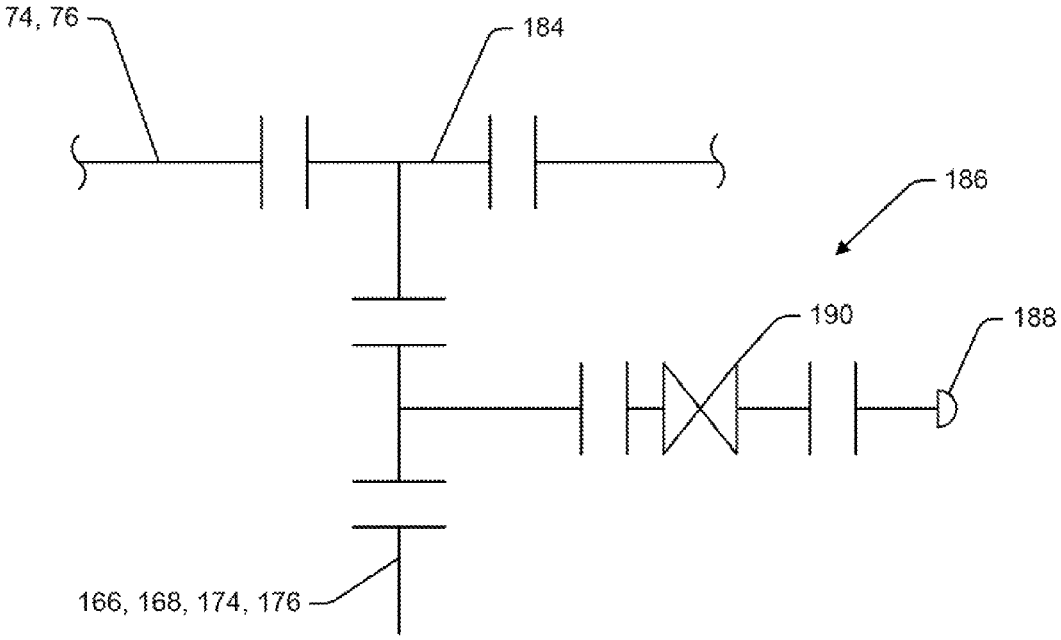
FIG. 5 is a detailed schematic diagram of an inlet coupling, a quick disconnect coupling, and relates lines as may be used in the gas turbine engine system of FIG. 3.

As is shown, the first and second branch compressor supply lines 166, 168 and the first and second branch turbine supply lines 174, 176 may be coupled to the respective first and second air extraction lines 74, 76 via inlet couplings 184. Further, the the first and second branch compressor supply lines 166, 168 and the first and second branch turbine supply lines 174, 176 may have quick disconnect couplings 186 positioned thereon adjacent the inlet couplings 184. FIG. 5 shows a detailed schematic diagram of the inlet couplings 184, the quick disconnect couplings 186, and the respective lines 74, 76, 166, 168, 174, 176. The inlet couplings 184 may be positioned on the respective first and second air extraction lines 74, 76 and configured to provide fluid communication between the first and second air extraction lines 74, 76 and the respective supply lines 166, 168, 174, 176. The quick disconnect couplings 186 may be positioned on the respective supply lines 166, 168, 174, 176 and configured to attach additional lines thereto, such as lines for introducing additional flows of water, a cleaning agent, a surface filming agent, or any other agent as may be desired during a wash process. As is shown, each quick disconnect coupling 186 may include a quick disconnect inlet 188 configured to attach an additional line thereto, and a quick disconnect valve 190 configured to control an additional flow therethrough. Other components and other configurations may be used herein.

The wash system 102 further may include an aerosolizing device 192. As used herein, "aerosolizing device" refers to any device suitable to form an aerosol spray of a liquid and a propellant. The aerosolizing device 192 may be in fluid communication with a propellant source (not shown) and configured to form an aerosol spray of the film-forming mixture and a propellant. The propellant may be any propellant suitable for use in the environment of the gas turbine engine 10. In certain embodiments, the propellant may be compressed air. In certain embodiments, the aerosolizing device 192 may be positioned along the mixture supply line 128. In this manner, during operation of the aerosolizing device 192, the mixture supply line 128 may provide the aerosol spray of the film-forming mixture and the propellant for delivery to the targeted internal components of the gas turbine engine 10. In certain embodiments, the wash system 102 may include a number of aerosolizing devices 192 each positioned along one of the bellmouth supply line 156, the first branch compressor supply line 166, the first branch compressor supply line 168, the first branch turbine supply line 174, and the second branch turbine supply line 176. In this manner, during operation of the aerosolizing devices 192, the respective supply lines 156, 166, 168, 174, 176 may provide the aerosol sprays of the film-forming mixture and the propellant for delivery to the targeted internal components of the gas turbine engine 10.

Figure 6:
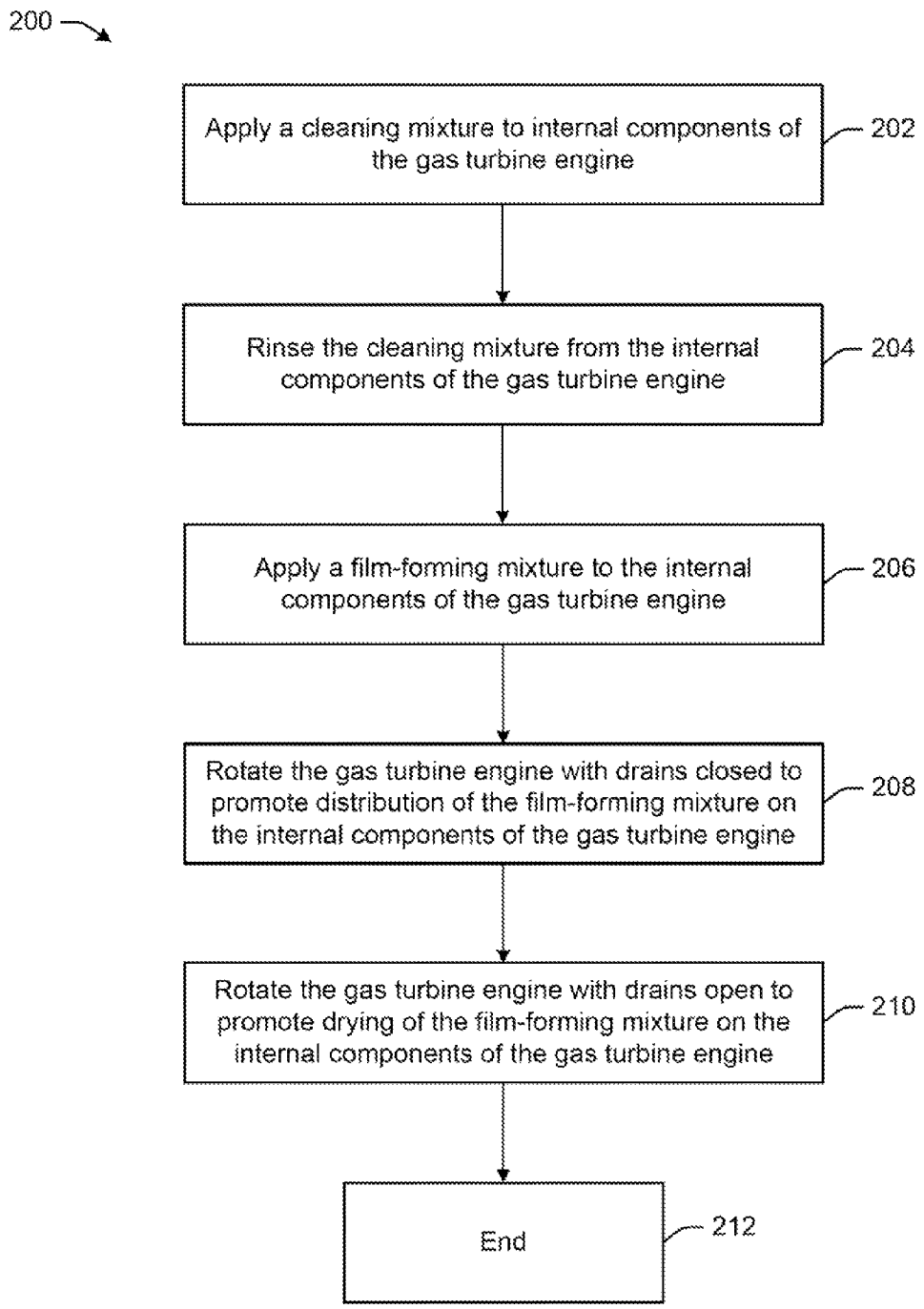
FIG. 6 is a flow diagram of a wash method as may be carried out with the gas turbine engine system of FIG. 3.

FIG. 6 shows a flow diagram of a wash method 200 as may be carried out with the gas turbine engine system 100. The wash method 200 may include applying the cleaning mixture to internal components of the gas turbine engine 10, as is shown at step 202. The wash method 200 also may include rinsing the cleaning mixture from the internal components of the gas turbine engine 10, as is shown at step 204. The wash method 200 further may include applying the film-forming mixture to the internal components of the gas turbine engine 10, as is shown at step 206. The wash method 200 further may include rotating the gas turbine engine 10 to promote distribution of the film-forming mixture on the internal components of the gas turbine engine 10, as is shown at step 208. The wash method 200 further may include rotating the gas turbine engine 10 to promote drying of the film-forming mixture on the internal components of the gas turbine engine 10, as is shown at step 210. The wash method 200 may end, as is shown at step 212, at which point the gas turbine engine 10 may be restarted and operate so as to produce mechanical work.

The wash method 200 may be an off-line wash method carried out while the gas turbine engine 10 is shut down or operating at turning gear speed and is not loaded. Prior to step 202, the gas turbine engine 10 may be permitted to cool down until the surfaces of the internal components of the gas turbine engine have reached a temperature at or below 145° F. (63° C.). Such cooling may prevent thermal shock, creep, and deformation of the internal components upon application of the cleaning mixture, the rinse, or the film-forming mixture during the wash method 200.

As described above, the cleaning mixture may be formed by mixing the water 110 and the cleaning agent 114 in the mixing chamber 120. The water 110 and the cleaning agent 114 may be mixed at a predetermined ratio. The predetermined ratio may be selected based on the particular materials of the internal components of gas turbine engine 10 to be cleaned and the application conditions, such as the extent of contaminant accumulation on the internal components. Further, the predetermined ratio may be selected based on the particular internal components, such as the compressor blades 56 and the compressor vanes 60, to be cleaned. From the mixing chamber 120, the cleaning mixture may be directed toward the gas turbine engine 10 via the mixture supply line 128.

At step 202, the cleaning mixture may be applied to the internal components of the gas turbine engine 10, such as the compressor blades 56 and the compressor vanes 60. In certain embodiments, at least a portion of the cleaning mixture may be delivered through the bellmouth supply line 156 and injected about the bellmouth 64 of the compressor 15 via the bellmouth manifold 158. In certain embodiments, at least a portion of the cleaning mixture may be delivered through the main compressor supply line 156, the first branch compressor supply line 166, and the first air extraction line 74, and injected into the respective stage 54 (such as the ninth stage) of the compressor 15 via the respective inlet ports 78. In certain embodiments, at least a portion of the cleaning mixture may be delivered through the main compressor supply line 156, the second branch compressor supply line 168, and the second air extraction line 76, and injected into the respective stage 54 (such as the thirteenth stage) of the compressor 15 via the respective inlet ports 78. In certain embodiments, at least a portion of the cleaning mixture may be delivered through the main turbine supply line 172, the first branch turbine supply line 174, and the first air extraction line 74, and injected into the respective stage 68 (such as the third stage) of the turbine 40 via the respective outlet ports 80. In certain embodiments, at least a portion of the cleaning mixture may be delivered through the main turbine supply line 172, the second branch turbine supply line 176, and the second air extraction line 76, and injected into the respective stage 68 (such as the second stage) of the turbine 40 via the respective outlet ports 80.

In certain embodiments, portions of the cleaning mixture may be simultaneously injected into the bellmouth 64 of the compressor 15 and the respective stages 54 of the compressor 15. In certain embodiments, portions of the cleaning mixture may be simultaneously injected into the respective stages 54 of the compressor 15 and the respective stages 68 of the turbine 40. In certain embodiments, portions of the cleaning mixture may be simultaneously injected into the bellmouth 64 of the compressor 15, the respective stages 54 of the compressor 15, and the respective stages 68 of the turbine 40. In certain embodiments, portions of the cleaning mixture may be injected into the bellmouth 64 of the compressor 15, the respective stages 54 of the compressor 15, and the respective stages 68 of the turbine 40 at different times.

In certain embodiments, portions of the cleaning mixture may be injected into the bellmouth 64 of the compressor 15, the respective stages 54 of the compressor 15, and the respective stages 68 of the turbine 40 at different times, and the portions of the cleaning mixture may have different predetermined ratios of the water 110 and the cleaning agent 114. For example, the portions of the cleaning mixture injected into the bellmouth 64 of the compressor 15 and the respective stages 54 of the compressor 15 may have a first ratio, and the portion of the cleaning mixture injected into the respective stages 68 of the turbine 40 may have a second ratio, wherein the first ratio is different than the second ratio. As discussed above, the predetermined ratios may be selected based on the particular materials of the internal components of gas turbine engine 10 to be cleaned and the application conditions. By tailoring the ratios in this manner, the efficiency and/or effectiveness of the wash process 200 may be increased.

At step 204, the cleaning mixture may be rinsed from the internal components of the gas turbine engine 10, such as the compressor blades 56 and the compressor vanes 60, via one or more flows of the water 110. In certain embodiments, portions of the water 110 may be injected into the bellmouth 64 of the compressor 15, the respective stages 54 of the compressor 15, and the respective stages 68 of the turbine 40. The portions of the 110 may be injected into these portions of the gas turbine engine 10 simultaneously or at different times via the same lines used to deliver the cleaning mixture. After rinsing the cleaning mixture from the internal components, the gas turbine engine 10 may be rotated with respective drains open to allow the water 110, the cleaning mixture, and contaminants to drain therefrom.

As described above, the film-forming mixture may be formed by mixing the water 110 and the surface filming agent 118 in the mixing chamber 120. In certain embodiments, the water 110 may be provided to the mixing chamber 120 in a liquid phase, and the surface filming agent 118 may be provided to the mixing chamber 120 in a liquid phase. In such embodiments, the resulting film-forming mixture formed in the mixing chamber 120 may be in a liquid phase (i.e., the film-forming mixture is a liquid mixture, specifically an aqueous mixture), and the film-forming mixture may be applied to the internal components of the gas turbine engine 10 in a liquid phase. In this manner, the water 110 may act as a liquid carrier for the surface filming agent 118, which also is in a liquid phase. The water 110 thus may carry the surface filming agent 118 through the respective supply lines and to the targeted internal components of the gas turbine engine 10. In certain embodiments, the film-forming mixture may be devoid of surface filming agent gas, water vapor (i.e., steam), and/or air. The water 110 and the surface filming agent 118 may be mixed at a predetermined ratio. The predetermined ratio may be selected based on the particular materials of the internal components of gas turbine engine 10 to be cleaned and the application conditions. Further, the predetermined ratio may be selected based on the particular internal components, such as the compressor blades 56 and the compressor vanes 60, on which the film is to be formed. From the mixing chamber 120, the film forming mixture may be directed toward the gas turbine engine 10 via the mixture supply line 128. As described above, the one or more aerosolizing devices 192 may form the aerosol spray of the film-forming mixture and the propellant for delivery to the targeted internal components of the gas turbine engine 10.

At step 206, the aerosol spray of the film-forming mixture and the propellant may be applied to the internal components of the gas turbine engine 10, such as the compressor blades 56 and the compressor vanes 60. As described above, the film-forming mixture may be applied to the internal components of the gas turbine engine 10 as a liquid mixture. In certain embodiments, at least a portion of the aerosol spray of the film-forming mixture and the propellant may be delivered through the bellmouth supply line 156 and injected about the bellmouth 64 of the compressor 15 via the bellmouth manifold 158. In certain embodiments, at least a portion of the aerosol spray of the film-forming mixture and the propellant may be delivered through the main compressor supply line 156, the first branch compressor supply line 166, and the first air extraction line 74, and injected into the respective stage 54 (such as the ninth stage) of the compressor 15 via the respective inlet ports 78. In certain embodiments, at least a portion of the aerosol spray of the film-forming mixture and the propellant may be delivered through the main compressor supply line 156, the second branch compressor supply line 168, and the second air extraction line 76, and injected into the respective stage 54 (such as the thirteenth stage) of the compressor 15 via the respective inlet ports 78. In certain embodiments, at least a portion of the aerosol spray of the film-forming mixture and the propellant may be delivered through the main turbine supply line 172, the first branch turbine supply line 174, and the first air extraction line 74, and injected into the respective stage 68 (such as the third stage) of the turbine 40 via the respective outlet ports 80. In certain embodiments, at least a portion of the aerosol spray of the film-forming mixture and the propellant may be delivered through the main turbine supply line 172, the second branch turbine supply line 176, and the second air extraction line 76, and injected into the respective stage 68 (such as the second stage) of the turbine 40 via the respective outlet ports 80.

In certain embodiments, portions of the aerosol spray of the film-forming mixture and the propellant may be simultaneously injected into the bellmouth 64 of the compressor 15 and the respective stages 54 of the compressor 15. In certain embodiments, portions of the aerosol spray of the film-forming mixture and the propellant may be simultaneously injected into the respective stages 54 of the compressor 15 and the respective stages 68 of the turbine 40. In certain embodiments, portions of the aerosol spray of the film-forming mixture and the propellant may be simultaneously injected into the bellmouth 64 of the compressor 15, the respective stages 54 of the compressor 15, and the respective stages 68 of the turbine 40. In certain embodiments, portions of the aerosol spray of the film-forming mixture and the propellant may be injected into the bellmouth 64 of the compressor 15, the respective stages 54 of the compressor 15, and the respective stages 68 of the turbine 40 at different times.

In certain embodiments, portions of the aerosol spray of the film-forming mixture and the propellant may be injected into the bellmouth 64 of the compressor 15, the respective stages 54 of the compressor 15, and the respective stages 68 of the turbine 40 at different times, and the respective portions of the film-forming mixture may have different predetermined ratios of the water 110 and the surface filming agent 118. For example, the portions of the film-forming mixture injected into the bellmouth 64 of the compressor 15 and the respective stages 54 of the compressor 15 may have a first ratio, and the portion of the film-forming mixture injected into the respective stages 68 of the turbine 40 may have a second ratio, wherein the first ratio is different than the second ratio. As discussed above, the predetermined ratios may be selected based on the particular materials of the internal components of gas turbine engine 10 to be cleaned and the application conditions. By tailoring the ratios in this manner, the efficiency and/or effectiveness of the wash process 200 may be increased.

At step 208, the gas turbine engine 10 may be rotated with respective drains closed to promote distribution of the film-forming mixture on the surfaces of the internal components of the gas turbine engine 10, such as the compressor blades 56 and the compressor vanes 60. In this manner, the film-forming mixture may be distributed on all of the surfaces of the targeted internal components of the gas turbine engine 10, including the compressor blades 56 and the compressor vanes 60 of the later stages 54 of the compressor 15.

At step 210, the gas turbine engine 10 may be rotated with respective drains open to promote drying of the film-forming mixture on the internal components of the gas turbine engine 10, such as the compressor blades 56 and the compressor vanes 60. In this manner, the film-forming mixture may form the protective film on the surfaces of the internal components of the gas turbine engine 10, such as the compressor blades 56 and the compressor vanes 60. Following completion of the wash method 200, the gas turbine engine 10 may be restarted and operate so as to produce mechanical work.

As discussed above, the system controller 104 may be operable to carry out and control the steps of the wash method 200. Further, the system controller 104 may be operable to monitor and control various operating parameters of the gas turbine engine 10 and the wash system 102, which may determine the timing of the steps of the wash method 200. The system controller 104 may be any type of programmable logic device. In certain embodiments, the system controller 104 may control various aspects of the wash system 102, including the pumps 132, 140, 148, the valves 82, 134, 136, 142, 144, 150, 152, 162, 170, 178, 180, and the valve interlock 182. The gas turbine engine system 100 may include various types of sensors to provide feedback to the system controller 104 regarding various operating conditions of the gas turbine engine 10 and the wash system 102. Access to the system controller 104 may be restricted to limit modification of the operating parameters of the wash method 200 by authorized personnel only.

The gas turbine engine system 100 described herein above thus provides an improved wash system 102 and wash method 200 for removing contaminants from and applying a surface filming agent to internal components of the gas turbine engine 10, such as the compressor blades 56 and compressor vanes 60. Specifically, the wash system 102 and wash method 200 effectively remove contaminants from the blades 56 and vanes 60 of all stages 54 of the compressor 15, including later compressor stages 54, while also inhibiting surface rusting, corrosion, and subsequent accumulation of contaminants on the blades 56 and vanes 60. Further, as compared to conventional wash systems and methods, the wash system 102 and wash method 200 increase the duration of performance gains provided thereby and thus decrease the frequency of washes required to maintain adequate performance of the gas turbine engine 10. Ultimately, the wash system 102 and wash method 200 increase efficiency and performance of the gas turbine engine 10 and decrease total operating costs.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A wash system for a component, the wash system comprising:

a water source containing a volume of water therein;

a surface filming agent source containing a volume of a surface filming agent therein;

a mixing chamber in fluid communication with the water source and the surface filming agent source, wherein the mixing chamber is configured to mix the water and the surface filming agent therein to produce a film-forming mixture;

an aerosolizing device in fluid communication with the mixing chamber and containing a propellant therein, wherein the aerosolizing device is configured to form an aerosol spray of the film-forming mixture and the propellant; and a plurality of supply lines in fluid communication with the aerosolizing device, wherein the supply lines are configured to direct the aerosol spray onto the component.

2. The wash system of claim 1, wherein the surface filming agent comprises a fluoro silane and an additional silane.

3. The wash system of claim 2, wherein the additional silane is selected from a group consisting of mercapto silane, amino silane, tetraethyl orthosilicate, and succinic anhydride silane.

4. The wash system of claim 1, wherein the surface filming agent comprises silane and mercapto silane.

5. The wash system of claim 1, wherein the film-forming mixture is a liquid mixture.

6. The wash system of claim 1, wherein the component comprises a gas turbine engine, and wherein the supply lines comprise a bellmouth supply line configured to direct the aerosol spray to a compressor bellmouth of the gas turbine engine.

7. The wash system of claim 1, wherein the component comprises a gas turbine engine, and wherein the supply lines comprise a compressor supply line configured to direct the aerosol spray to one or more stages of a compressor of the gas turbine engine.

8. The wash system of claim 1, wherein the component comprises a gas turbine engine, and wherein the supply lines comprise a turbine supply line configured to direct the aerosol spray to one or more stages of a turbine of the gas turbine engine.

9. The wash system of claim 1, wherein the component comprises a gas turbine engine, wherein the wash system further comprises a cleaning agent source containing a volume of a cleaning agent therein, wherein the mixing chamber is in fluid communication with the cleaning agent source and is configured to mix the water and the cleaning agent therein to produce a cleaning mixture, and wherein the supply lines are configured to direct the cleaning mixture into the gas turbine engine.

10. A method of washing a gas turbine engine to remove contaminants therefrom, the method comprising:

providing a wash system comprising:

a water source containing a volume of water therein;

a surface filming agent source containing a volume of a surface filming agent therein:

a mixing chamber in fluid communication with the water source and the surface filming agent source, wherein the mixing chamber is configured to mix the water and the surface filming agent therein to produce a film-forming mixture;

an aerosolizing device in fluid communication with the mixing chamber and containing a propellant therein, wherein the aerosolizing device is configured to form an aerosol spray of the film-forming mixture and the propellant; and a plurality of supply lines in fluid communication with the aerosolizing device;

directing a cleaning mixture through an air extraction system of the gas turbine engine, wherein the cleaning mixture comprises water and a cleaning agent;

applying the cleaning mixture to internal components of the gas turbine engine;

rinsing the cleaning mixture from the internal components;

directing the aerosol spray through the air extraction system;

applying the aerosol spray to the internal components; and drying the film-forming mixture to form a protective film on the internal components.

11. The method of claim 10, wherein the surface filming agent comprises a fluoro silane and an additional silane.

12. The method of claim 10, wherein the surface filming agent comprises silane and mercapto silane.

13. The method of claim 10, wherein the film-forming mixture is a liquid mixture.

14. The method of claim 10, wherein the supply lines comprise a bellmouth supply line in communication with a compressor bellmouth of the gas turbine engine, and wherein the method further comprises directing the aerosol spray through the bellmouth supply line to the compressor bellmouth.

15. A gas turbine engine system, comprising:

a gas turbine engine, comprising:

a compressor;

a combustor in communication with the compressor;

a turbine in communication with the combustor; and an air extraction system in communication with the compressor and the turbine;

a wash system, comprising:

a water source containing a volume of water therein;

a surface filming agent source containing a volume of a surface filming agent therein;

a mixing chamber in fluid communication with the water source and the surface filming agent source, wherein the mixing chamber is configured to mix the water and the surface filming agent therein to produce a film-forming mixture;

an aerosolizing device in fluid communication with the mixing chamber and containing a propellant therein, wherein the aerosolizing device is configured to form an aerosol spray of the film-forming mixture and the propellant; and a plurality of supply lines in fluid communication with the mixing chamber, the aerosolizing device, and the air extraction system, wherein the supply lines are configured to direct the aerosol spray into the compressor and the turbine via the air extraction system.

16. The gas turbine engine system of claim 15, wherein the surface filming agent comprises a fluoro silane and an additional silane.

17. The gas turbine engine system of claim 16, wherein the additional silane is selected from a group consisting of mercapto silane, amino silane, tetraethyl orthosilicate, and succinic anhydride silane.

18. The gas turbine engine system of claim 15, wherein the film-forming mixture is a liquid mixture.

19. The gas turbine engine system of claim 15, wherein the air extraction system comprises:

a first air extraction line extending between one stage of the compressor and one stage of the turbine, wherein the first air extraction line is configured to direct the aerosol spray to the one stage of the compressor and the one stage of the turbine; and a second air extraction line extending between another stage of the compressor and another stage of the turbine, wherein the second air extraction line is configured to direct the aerosol spray to the other stage of the compressor and the other stage of the turbine.

20. The gas turbine engine system of claim 19, wherein the one stage of the compressor is a ninth stage of the compressor, wherein the one stage of the turbine is a third stage of the turbine, wherein the other stage of the compressor is a thirteenth stage of the compressor, and wherein the other stage of the turbine is a second stage of the turbine.

* * * * *